US006290166B1

(12) United States Patent
Aramaki et al.

(10) Patent No.: US 6,290,166 B1
(45) Date of Patent: Sep. 18, 2001

(54) WIRE-WINDING DEVICE

(75) Inventors: Noriyoshi Aramaki; Akihiro Uehara, both of Kawaguchi (JP)

(73) Assignee: Aramaki Technica Co., Ltd., Saitama (JP)

( * ) Notice: Subject to any disclaimer, the term of this patent is extended or adjusted under 35 U.S.C. 154(b) by 0 days.

(21) Appl. No.: 09/642,932

(22) Filed: Aug. 22, 2000

(30) Foreign Application Priority Data

Aug. 23, 1999 (JP) ..... 11-235699

(51) Int. Cl.[7] ..... B65H 54/28; B65H 81/06

(52) U.S. Cl. ..... 242/484.4; 242/443; 242/486.4; 242/615.2

(58) Field of Search ..... 242/484.2, 484.3, 242/484.4, 443, 486.4, 470, 615.2

(56) References Cited

U.S. PATENT DOCUMENTS 1,884,409 * 10/1932 Vienneau ..... 242/447.2
4,059,239 * 11/1977 Hori et al. ..... 242/486.4 X
4,106,710 * 8/1978 Schippers et al. ..... 242/486.4
4,570,875 * 2/1986 Buluschek ..... 242/478.2
5,681,006 * 10/1997 Herd et al. ..... 242/447.1

* cited by examiner

*Primary Examiner*—Michael R. Mansen
(74) *Attorney, Agent, or Firm*—Lowe Hauptman Gilman & Berner, LLP

(57) ABSTRACT

A wire-winding device is characterized, by including a stand, a wire reel carried to the stand with an axis, a carrier with an axis parallelly arranged to that of the wire reel, a guide reel having a drum formed in a beer barrel with side-flanges and rotary supported to the carrier, an apparatus for movably supporting the carrier, and an apparatus for biasing the carrier in such a manner that a wire to be wound is maintained so as to be turned to the wire reel at a predetermined turning point.

4 Claims, 7 Drawing Sheets

PRIOR ART

WIRE-WINDING DEVICE

DESCRIPTION OF THE INVENTION

1) The Technical Field of this Invention

This invention relates to a wire-winding device used for winding a wire around a wire reel in such a manner that the wire turning parallelly to the reel in a line.

2) The Prior Arts

Generally, the prior wire-winding device comprises a stand 301, a wire reel 302 carried to the stand with an axis, a guide reel 303 having a drum 303*a* formed in a beer barrel with side-flanges 303*b*, 303*b* and rotary supported by a stationary frame 304, as shown in FIG. 7. The reference number 305 is a pole-shaped supporting member which depresses the wire turns W1 in the radial direction of the wire reel 302.

In operation, a wire W is introduced to the turning position of the wire reel 302 via the guide reel 303 so as to be wound in a line in a condition that the wire turns are tightly attached side by side. However, the prior wire-winding device involves a problem that the turning point P of the wire W to the wire reel 302 is varied on the turns to be shifted toward the guide reel 303 according to the wire turns W1 increased to the wire reel 302 in a superposed condition, so that the wire is inclined from a line A to a line B as shown in FIG. 7.

As a result, the wire W induced by the guide reel 303 is unavoidably offset from the best turning condition, thereby to lose the aligned condition of the wire turns to the wire reel 302.

3) SUMMARY OF THIS INVENTION

A wire-winding device according to this invention is characterized by comprising a stand, a wire reel carried to the stand with an axis, a carrier with an axis parallelly arranged to that of the wire reel, a guide reel having a drum formed in a beer barrel with side-flanges and rotary supported by the carrier, a means for movably supporting the carrier, and a means for biasing the carrier in such a manner that a wire to be wound is maintained so as to be turned to the wire reel at a predetermined turning point.

Accordingly, the wire turning point on the wire reel is maintained in constant by the carrier motion and the bias means, so that the wire induced to the wire reel is turned to the guide reel under the best condition in which the wire is turned side by side in a line on the superposed turns.

Furthermore, the wire-winding device of this invention includes a means for guiding the wire turns in a line at the turning point of wire to the wire reel. That is this guiding means comprises a guide member extended in parallel to the axis of the wire reel and a means for biasing the guide member to the radial direction of the wire reel so as to depress the wire turns.

Embodiments of this invention will be detailed in the reference of the description mentioned below with the following drawings.

4) BRIEF EXPLANATION OF THE DRAWINGS

5) EMBODIMENTS OF THIS INVENTION

Figure 1:
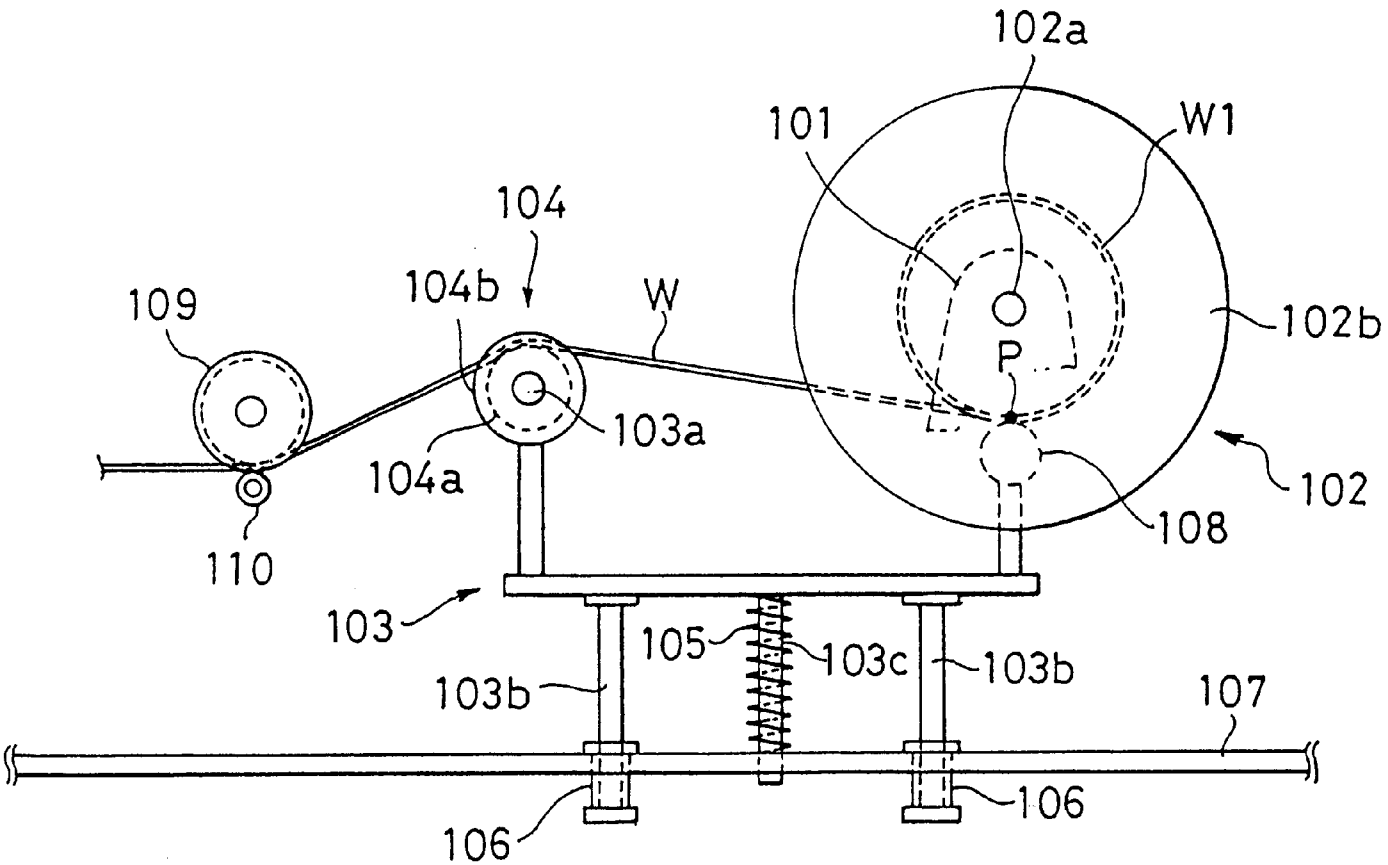
FIG. 1 is a side view of the wire-winding device of this invention in the first embodiment.
Figure 2:
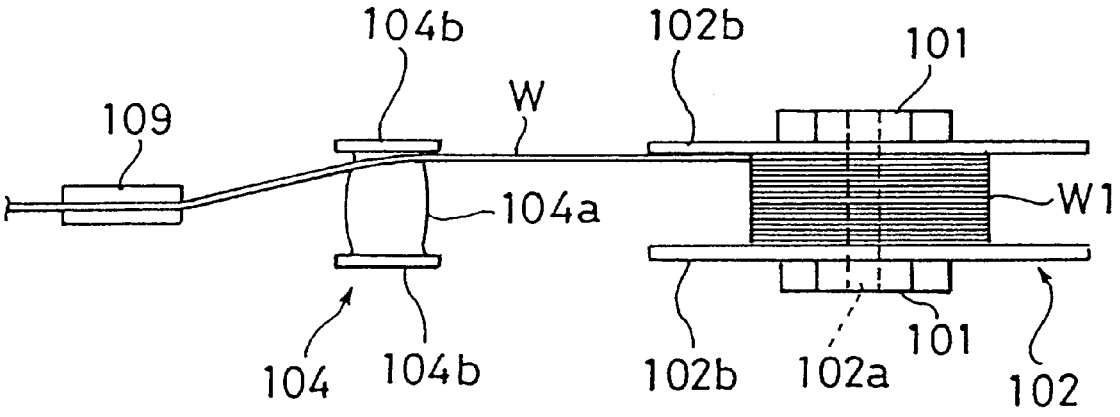
FIG. 2 is a plane view of the wire-winding device of FIG. 1.

The first embodiment of this invention is illustrated in FIGS. 1 to 5. There is provided an improved wire-winding device which comprises a stand 101, a wire reel 102 carried to the stand 101 with a horizontal axis 102*a*, a carrier 103 vertically movable, a guide reel 104 having a drum 104*a* formed in a beer barrel with side-flanges 104*b* and rotary supported by the carrier 103 with an axis 103*b* parallelly arranged to the axis 102*a*, and a means 105 for biasing the carrier 103 in such a manner that a wire W to be wound is maintained so as to be turned to the wire reel 102 at a predetermined turning point P.

As further detailed, the carrier 103 has guide poles 103*b* which is supported to the bottom of the carrier 103 in a slide condition to cylindrical supporters 106 attached to a base frame 107. The bias means 105 in this embodiment is a compression bias spring member disposed between the carrier 103 and the base frame 107, with its spring member turned around a pole 103*c* attached to the bottom of the carrier 103 and penetrating through a bore formed to the base frame 107.

Furthermore, the wire-winding device includes a means for guiding the wire W turns in a line at the turning point P of wire to the wire reel 102. That is this guiding means comprises a pole-shaped guide member 108 extended in parallel to the axis 102*a* of the wire reel 102 and disposed between the flanges 102*b*, 102*b*, and a means for biasing the guide member 108 at the point P to the radial direction of the wire reel 102 so as to depress the wire turns W1 superposed to the body of the wire reel 102. The above-mentioned spring member 105 is used in combination to the latter biasing means in this embodiment.

In FIGS. 1 to 5, the reference numbers 109 and 110 are a pair of guide rollers for inducing the wire W to the guide reel 104, one of which has side-flanges.

In operation, the wire W is turned in a line to the body of the wire-reel 102 so as to be depressed at the wire turning point P by the guide member 108 and the biasing means in a first stage as shown in FIG. 1. In this case, the wire W slides on the beer barrel of the guide reel 104 in a manner to retract side by side between the flanges 104*b*, 104*b*.

Figure 3:
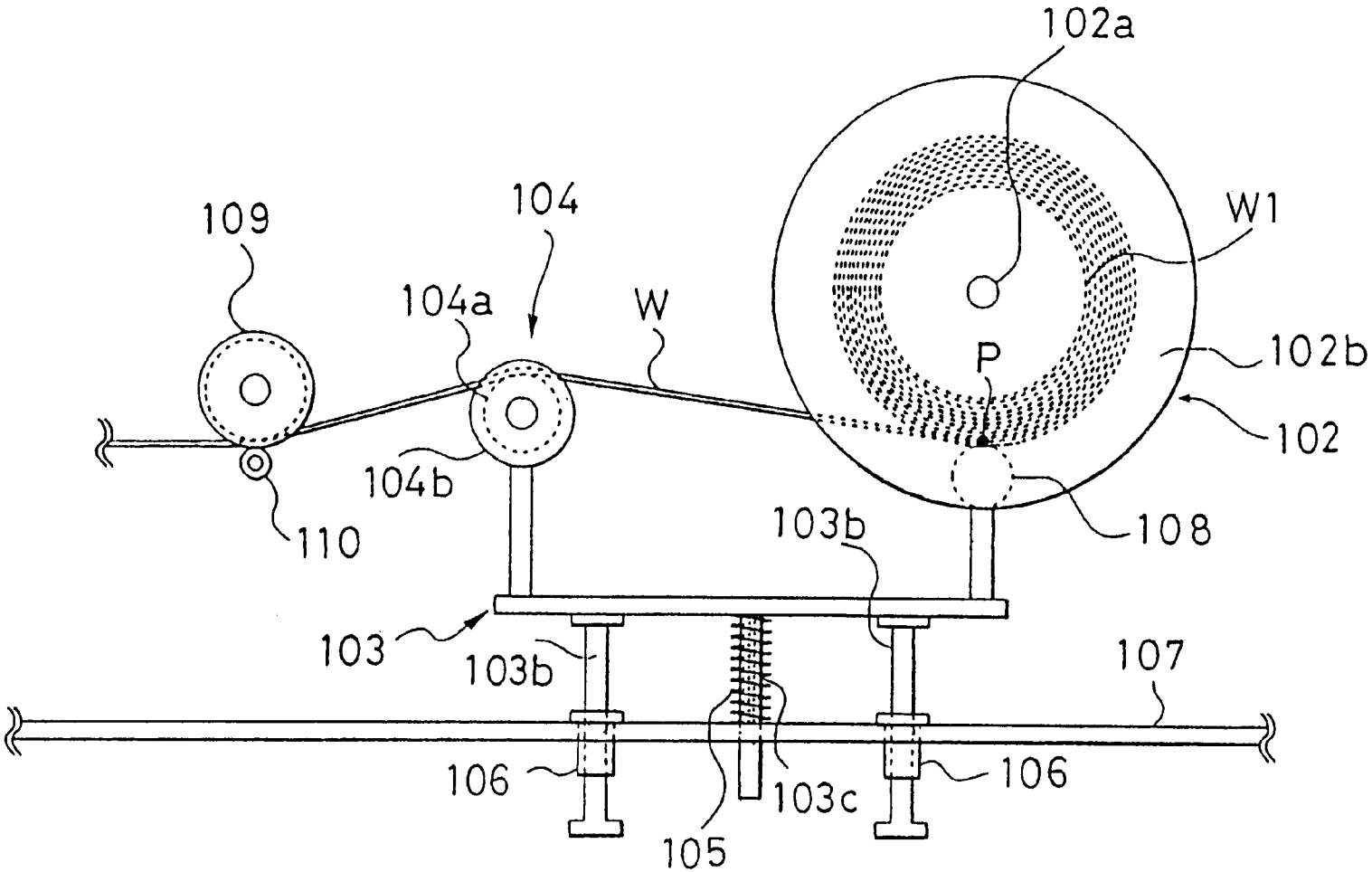
FIGS. 3 and 4 are side views of the wire-winding device of FIG. 1 in second and final stages.

In second stage, the wire W is turned in a line over the superposed turns W1 on the body of the wire reel 102 as shown in FIG. 3. In this case the wire turning point P is not shifted to the guide reel 104 and maintained at the best position as the same as that of the first stage, because the guide reel 104 is lowered together with the guide member 108 according to the carrier 103 against the bias of the spring member 105.

Figure 4:
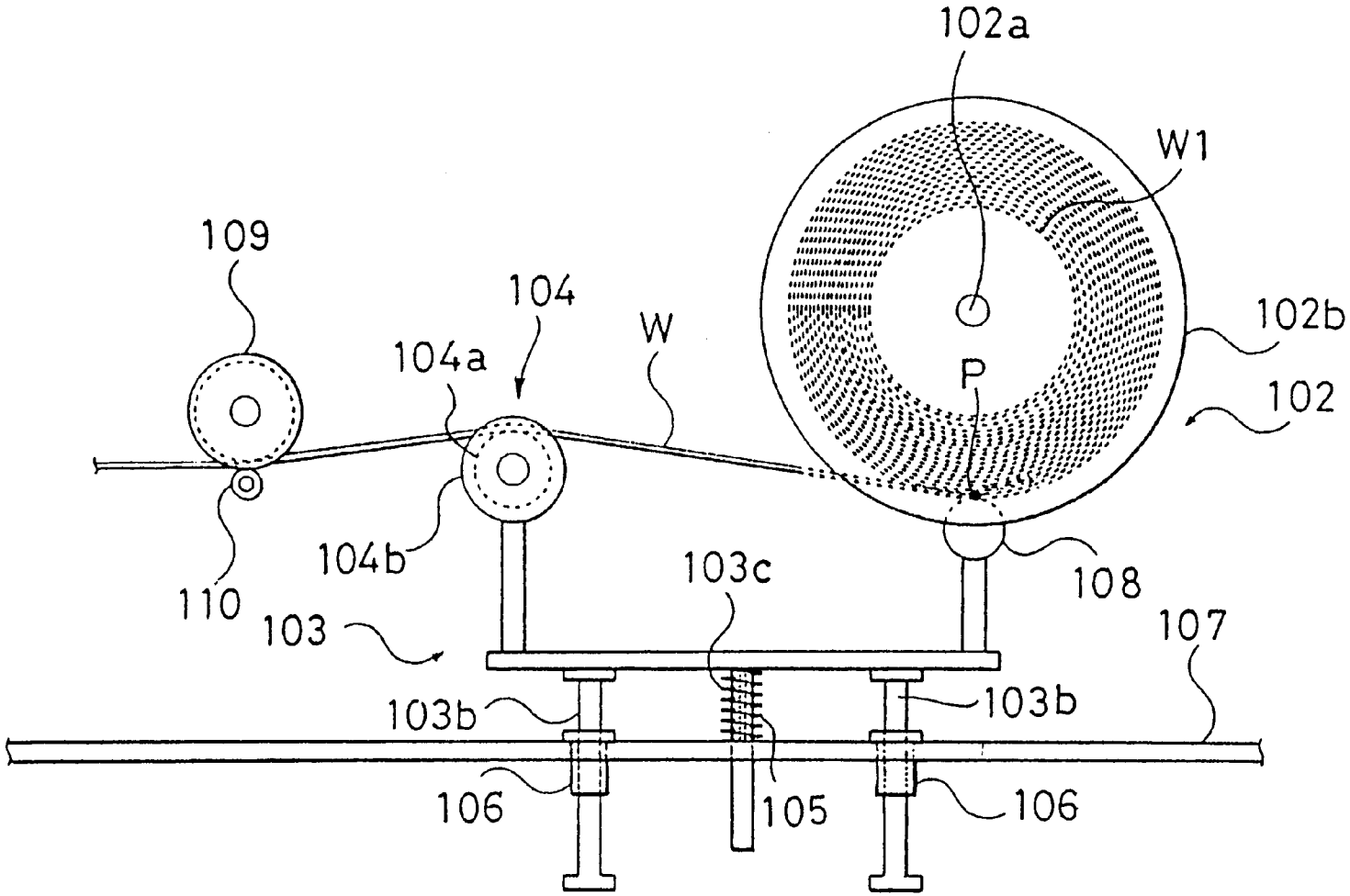

The final stage of the wire-winding operation to the wire reel 102 is illustrated in FIG. 4. In this case, the wire turning point P is not shifted to the guide reel 104 and also maintained at the best position as same as that of the first stage.

Accordingly, this wire-winding device in this embodiment is always used in the best condition so as to wind the wire W to the wire reel 102 in a period from the first stage to the final stage.

Figure 5:
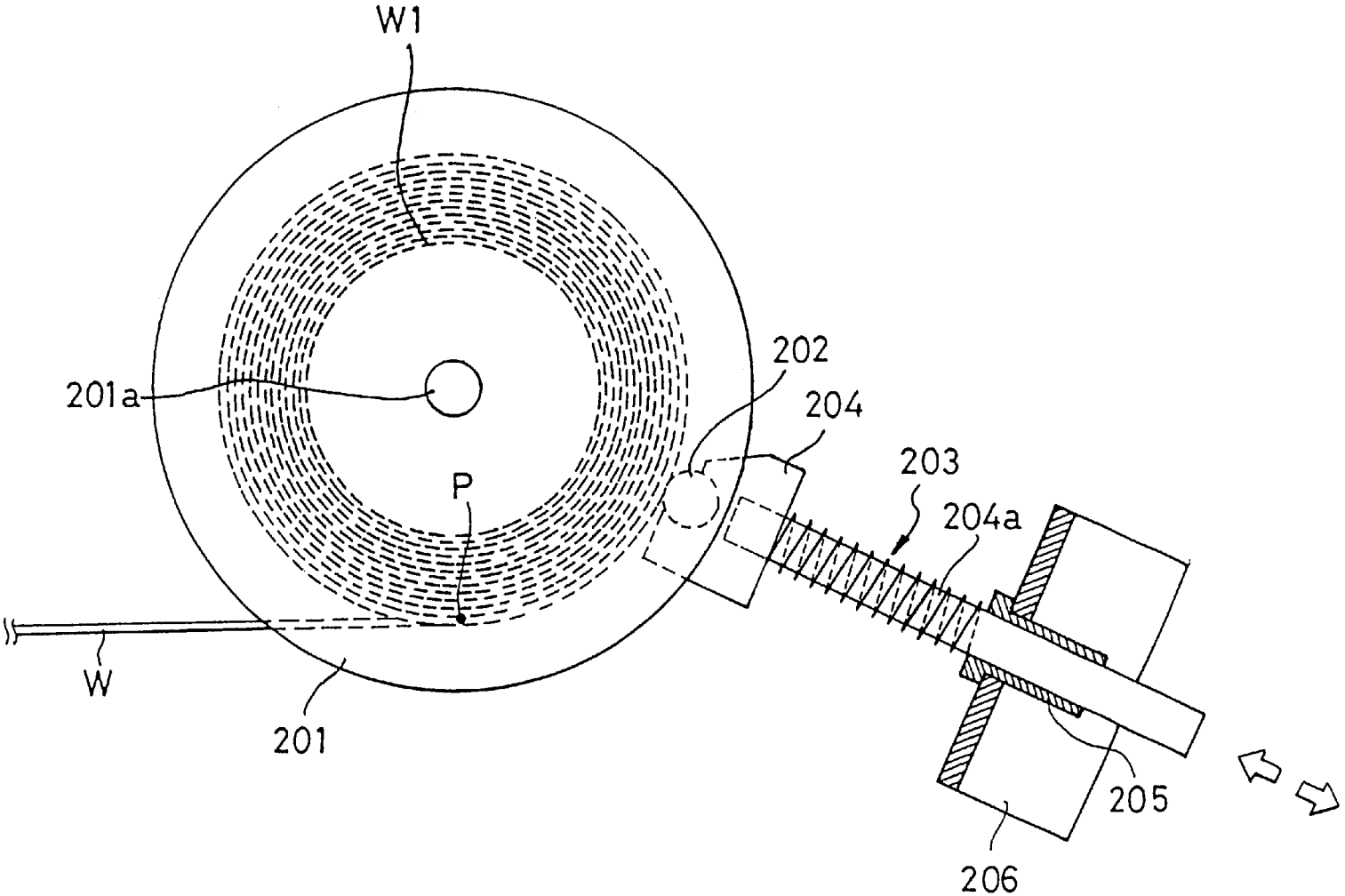
FIG. 5 is a side view of the wire-winding device of this invention in the first embodiment.
Figure 6:
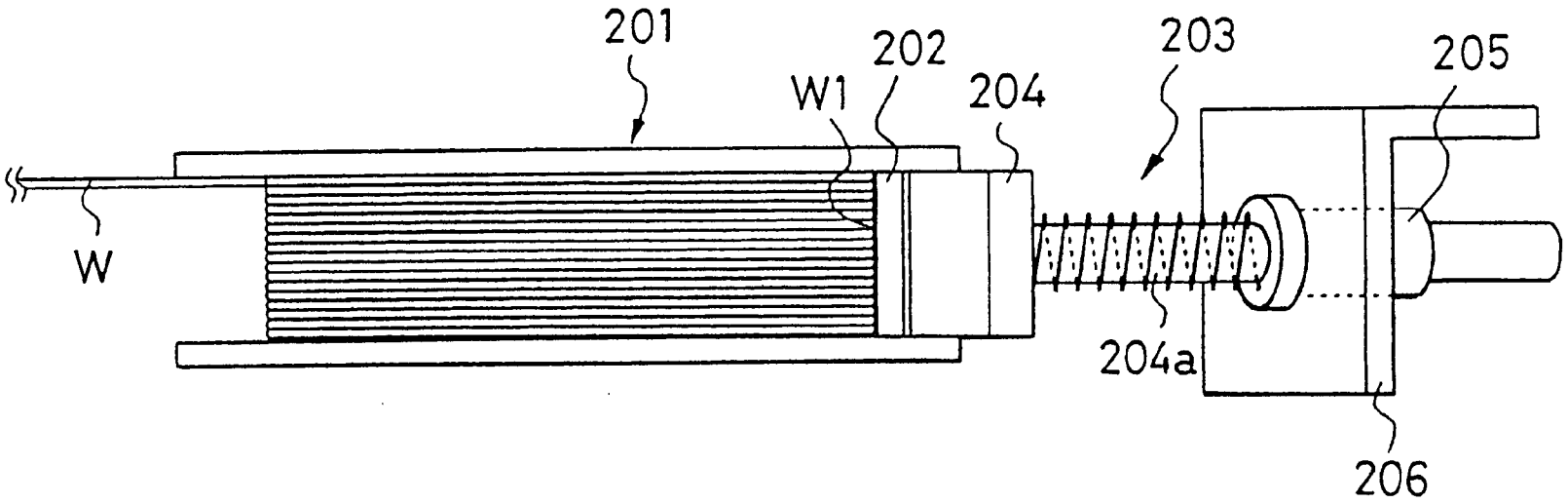
FIG. 6 is a plane view of the wire-winding device of FIG. 5.
Figure 7:
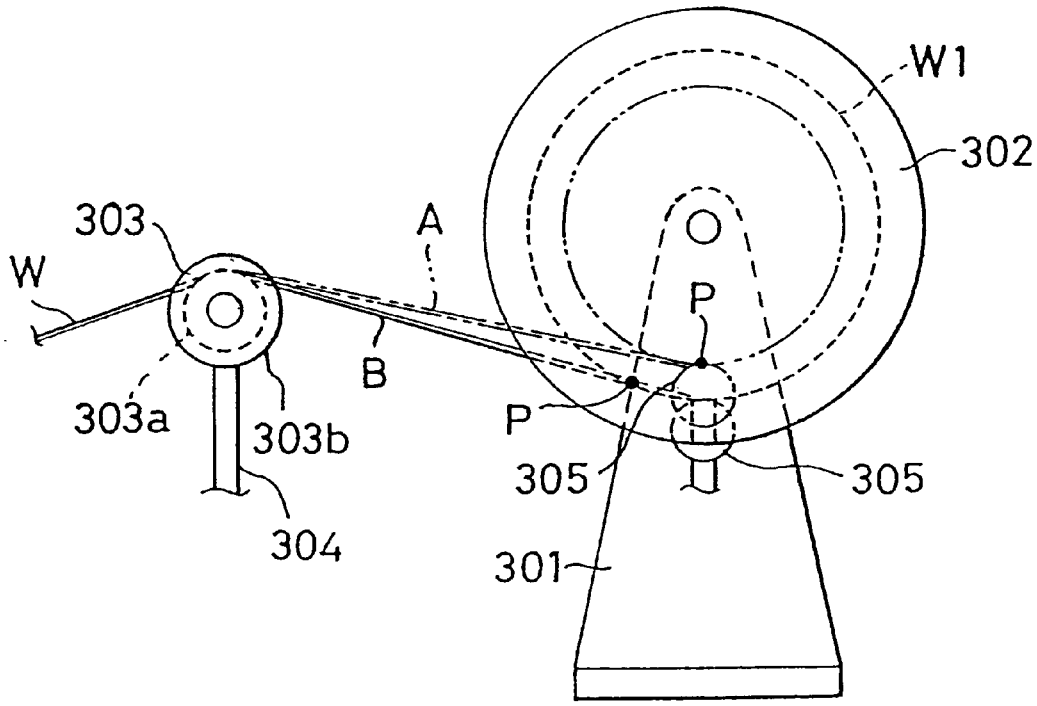
FIG. 7 is a side view of the wire-winding device of the prior art.

The second embodiment of this invention is illustrated in FIGS. 5 and 6. There is provided a wire-winding device which includes a wire-reel 201 with an axis 201*a* and having side flanges a pole-shaped guide member 202 extended in parallel to the axis 201*a* so as to align the wire turns on the body of the wire-reel 201 or the superposed turns W1, and a means 203 for biasing the guide member 202 so as to depress it to radial direction of the wire-reel.

In this case, the guide member 202 is supported to a concave surface formed to a supporter block 204 with a pole 204*a* which is supported by a cylindrical holder 205 in a slide condition, the holder 205 being supported by a supporting frame 206 inclined to the horizontal line, with the holder 205 penetrating through a bore formed to the frame 206. The biasing means 203 in this embodiment is a compression bias spring member disposed between the supporter block 204 and the supporting frame 205 with it turning around the pole 204*a*.

However, the guide member 202 is not placed at the wire turning point P on the body of the wire reel 201 or the superposed turns W1. It is different from that of the first embodiment. The other members used in the wire-winding device as same as those of the first embodiment are not shown in the drawings.

Accordingly, in this embodiment, the wire turning point P is not shifted to the guide reel, though it is not shown in the drawings, and also maintained at the best position as same as that of all the stages, and the wire-winding device also keeps the same merit as that of the first embodiment.

What is claimed is:

1. A wire-winding device comprising a stand, a wire reel carried to the stand with an axis, a carrier vertically movable, a guide reel having a drum formed in a beer barrel with side-flanges and rotary supported by the carrier with an axis parallelly arranged to that of the wire reel, and a means for biasing the carrier in such a manner that a wire to be wound is maintained so as to be turned to the wire reel at a predetermined turning point.

2. A wire-winding device claimed in claim 1, in which the carrier supports a guide member shaped into a pole for depressing the wire turns to the radial direction of the wire reel.

3. A wire-winding device claimed in claim 2, in which the bias means includes a compression bias spring member which is used in combination to that of the guide member, and the guide member depresses the wire turns at a wire-turning point.

4. A wire-winding device claimed in claim 2, in which the bias means includes a compression bias spring member which is displaced between a supporter block for the guide member and a supporting frame so as to depresse the guide member in the radial direction of the wire reel.

* * * * *